US011136824B2

(12) United States Patent
James, Jr.

(10) Patent No.: US 11,136,824 B2
(45) Date of Patent: Oct. 5, 2021

(54) ROOF EDGE LADDER GUARD

(71) Applicant: Harley D. James, Jr., Hillman, MI (US)

(72) Inventor: Harley D. James, Jr., Hillman, MI (US)

( * ) Notice: Subject to any disclaimer, the term of this patent is extended or adjusted under 35 U.S.C. 154(b) by 0 days.

(21) Appl. No.: 16/394,033

(22) Filed: Apr. 25, 2019

(65) Prior Publication Data

US 2019/0330921 A1 Oct. 31, 2019

Related U.S. Application Data

(60) Provisional application No. 62/663,461, filed on Apr. 27, 2018.

(51) Int. Cl.
*E06C 7/48* (2006.01)
*E06C 7/50* (2006.01)

(52) U.S. Cl.
CPC ..... *E06C 7/488* (2013.01); *E06C 7/48* (2013.01); *E06C 7/50* (2013.01)

(58) Field of Classification Search
CPC ... E06C 7/48; E06C 7/50; E06C 7/488; E06C 1/06; E06C 1/34
See application file for complete search history.

(56) References Cited

U.S. PATENT DOCUMENTS 1,478,823 A * 12/1923 Gauss ..... E06C 7/48 182/214
1,818,597 A * 8/1931 Adams ..... B64C 25/56 244/107

(Continued)

FOREIGN PATENT DOCUMENTS

CA 2476334 A1 * 1/2005 ..... E06C 7/48
CA 2936214 A1 * 1/2018 ..... E06C 7/48
GB 321074 A * 10/1929 ..... B64C 35/001

OTHER PUBLICATIONS

"Rail." Merriam-Webster.com Dictionary, Merriam-Webster, https://www.merriam-webster.com/dictionary/rail. Accessed Aug. 16, 2020. (Year: 2020).*

*Primary Examiner* — Colleen M Chavchavadze
*Assistant Examiner* — Candace L Bradford
(74) *Attorney, Agent, or Firm* — Northern Michigan Patent Law, PLC

(57) ABSTRACT

A ladder safety device configured to be secured to the edge of roof to prevent a ladder leaned against it from sliding sideways or falling away from the roof edge. The ladder safety device comprises a generally flat, planar inner body portion comprising a first inner horizontal rail and vertical rails spaced from one another to define a plurality of large hand-grip openings between them. The ladder safety device further includes an outer body portion comprising a second horizontal rail spaced vertically from the first horizontal rail and connected thereto by outer portions of the vertical rails. Fastener holes formed along inner ends of the vertical rails can be used to secure the device to a roof, and projecting outer fingers define a ladder recess on an outer edge of the outer body portion. The ladder safety device is installed with the outer horizontal rail and portions of the vertical rails and the hand-grip openings spaced outwardly from the roof edge to provide a hand grip.

8 Claims, 7 Drawing Sheets

(56) References Cited

U.S. PATENT DOCUMENTS 1,828,641 A * 10/1931 Bergeron ..... B64C 25/445 244/111
2,621,874 A * 12/1952 Boyle ..... B64C 25/56 244/101
3,102,705 A * 9/1963 Namsick ..... B64C 25/56 244/100 A
3,154,270 A * 10/1964 Jensen ..... B64C 25/56 244/101
3,189,301 A * 6/1965 Parkes ..... B64C 27/006 244/17.17
3,467,343 A * 9/1969 Violleau ..... B64C 25/56 244/17.17
3,507,466 A * 4/1970 La Fleur ..... B64C 25/56 244/105
4,451,016 A * 5/1984 Genovese ..... B64C 25/56 244/107
4,643,275 A * 2/1987 LeBlanc ..... E06C 7/48 182/107
4,697,762 A * 10/1987 Arney ..... B64C 25/56 244/100 A
4,799,907 A * 1/1989 Jankowiak ..... B63C 9/23 244/107
5,282,597 A * 2/1994 Babcock ..... E04D 13/12 248/237
5,775,465 A * 7/1998 Vossler ..... E06C 7/48 182/107
5,899,296 A * 5/1999 Lantz ..... E06C 7/48 182/214
5,975,239 A * 11/1999 Castaneda ..... E04G 21/3261 182/45
6,019,191 A 2/2000 Flores
6,722,469 B1 * 4/2004 Weger, Jr. ..... E06C 1/34 182/107
7,249,747 B2 * 7/2007 Marceau ..... A47B 23/002 108/43
7,309,267 B1 * 12/2007 Henry ..... B64C 25/56 244/107
2002/0108811 A1 * 8/2002 Ulmschneider ..... E06C 7/482 182/206
2003/0060101 A1 * 3/2003 Parrott ..... B64C 25/56 441/40
2004/0226498 A1 * 11/2004 Mears ..... B64D 25/18 114/68
2007/0278040 A1 * 12/2007 Rager ..... E06C 7/48 182/107
2014/0027202 A1 * 1/2014 Bancroft ..... E06C 7/188 182/107
2014/0319265 A1 * 10/2014 Cacciaguerra ..... B64C 27/22 244/6
2015/0027812 A1 * 1/2015 Budziak ..... E04G 21/3238 182/107
2015/0217862 A1 * 8/2015 Dijaux ..... B64C 25/54 244/105
2015/0337596 A1 * 11/2015 Cherevko ..... E06C 1/06 182/107
2016/0369563 A1 * 12/2016 Adcock ..... E06C 7/46
2017/0356245 A1 * 12/2017 Surdo ..... E06C 7/48
2018/0274295 A1 * 9/2018 Adams ..... E06C 7/48

* cited by examiner

ROOF EDGE LADDER GUARD

RELATED APPLICATIONS/PRIORITY BENEFIT CLAIM

This application claims the benefit of U.S. Provisional Application No. 62/663,461 filed Apr. 27, 2018 by the same inventor (James), the entirety of which provisional application is hereby incorporated by reference.

FIELD

The subject matter of the present application is in the field of safety devices for temporary mounting along roof edges to prevent ladders from sliding off or falling away from the roof.

BACKGROUND

Ladder safety devices that provide ladder-anchoring and roof-protecting functions are known. For example, people working on the roof may temporarily nail scrap pieces of lumber to project from the roof edge to secure a ladder between them.

A more structured, commercial example is shown in U.S. Pat. No. 6,722,469 to Weger, Jr., which discloses a rigid flat plate sized for installation between a roof and a roof covering, with nail holes and/or a puncturable plate material for attaching the plate to the roof, and a recess along an outer edge for receiving the ladder. The outer ladder-receiving edge projects beyond the edge of the roof as a "standoff" to protect the roof edge.

Difficulties with using ladder safety devices of the types above include carrying the materials or plates up a ladder, and maneuvering them under existing shingles or other roof coverings and holding them in place while nailing or screwing them to the roof—especially since the ladder is unsecured during the installation. Anything that can make it easier to install such safety devices while working at the top of an unsecured ladder is a welcome improvement.

BRIEF SUMMARY

The present invention is a ladder safety device that provides both a ladder-securing function and a roof-protecting standoff function. The ladder safety device includes structural features that make it easy to carry up a ladder, easy to maneuver into place under an existing roof covering such as a layer of shingles, and easy to nail or screw to the roof from a ladder that is unsecured during the initial installation.

The inventive ladder safety device, and its related installation method, also provides a convenient way to secure the ladder to the device using a chain or cable in a manner that allows the safety device to be removed with the ladder.

The ladder safety device and the related installation method also provide a convenient handhold for a worker at the edge of the roof.

The ladder safety device comprises a relatively flat, planar inner body portion comprising a plurality of spaced, flat, vertical rails and a first inner horizontal rail interconnecting their inner ends. The vertical rails define a plurality of large hand-grip sized openings between them. An outer body portion of the device comprises outer ends of the vertical rails, outer portions of the hand-grip openings, and a second outer horizontal rail interconnecting the outer ends of the vertical rails. A pair of ladder-securing fingers project from an outer edge of the outer body portion to prevent a ladder positioned between them from sliding sideways along the roof edge. In a particular form, the ladder safety device comprises inner and outer "horizontal" rails in a parallel spaced relationship; a plurality of "vertical" rails joining the inner and outer horizontal rails and spaced from each other in a horizontal direction; a pair of spaced fingers projecting outwardly from the outer horizontal rail at ends thereof; a plurality of fastener holes formed on the vertical rails adjacent the inner horizontal rail and/or on the inner horizontal rail itself; and a plurality of large, preferably rectangular openings formed between the horizontal and vertical rails sufficient large to admit a user's hand.

In a further form, the outer body portion is angled upwardly relative to the inner body portion, such that the outer body portion is substantially level to clear a gutter at the edge of the roof when the inner body portion is positioned flat against a roof.

In a further form the invention includes a method of installing the ladder safety device to a roof edge, in which the inner horizontal rail and inner portions of the spaced vertical rails are secured against the roof, and in which the outer horizontal rail, the ladder-securing fingers, the outer portions of the vertical rails, and the outer portions of the hand-grip openings between the rails project beyond the roof edge.

These and other features and advantages of the invention will become apparent from the detailed description below, in light of the accompanying drawings.

DETAILED DESCRIPTION

Figure 1:
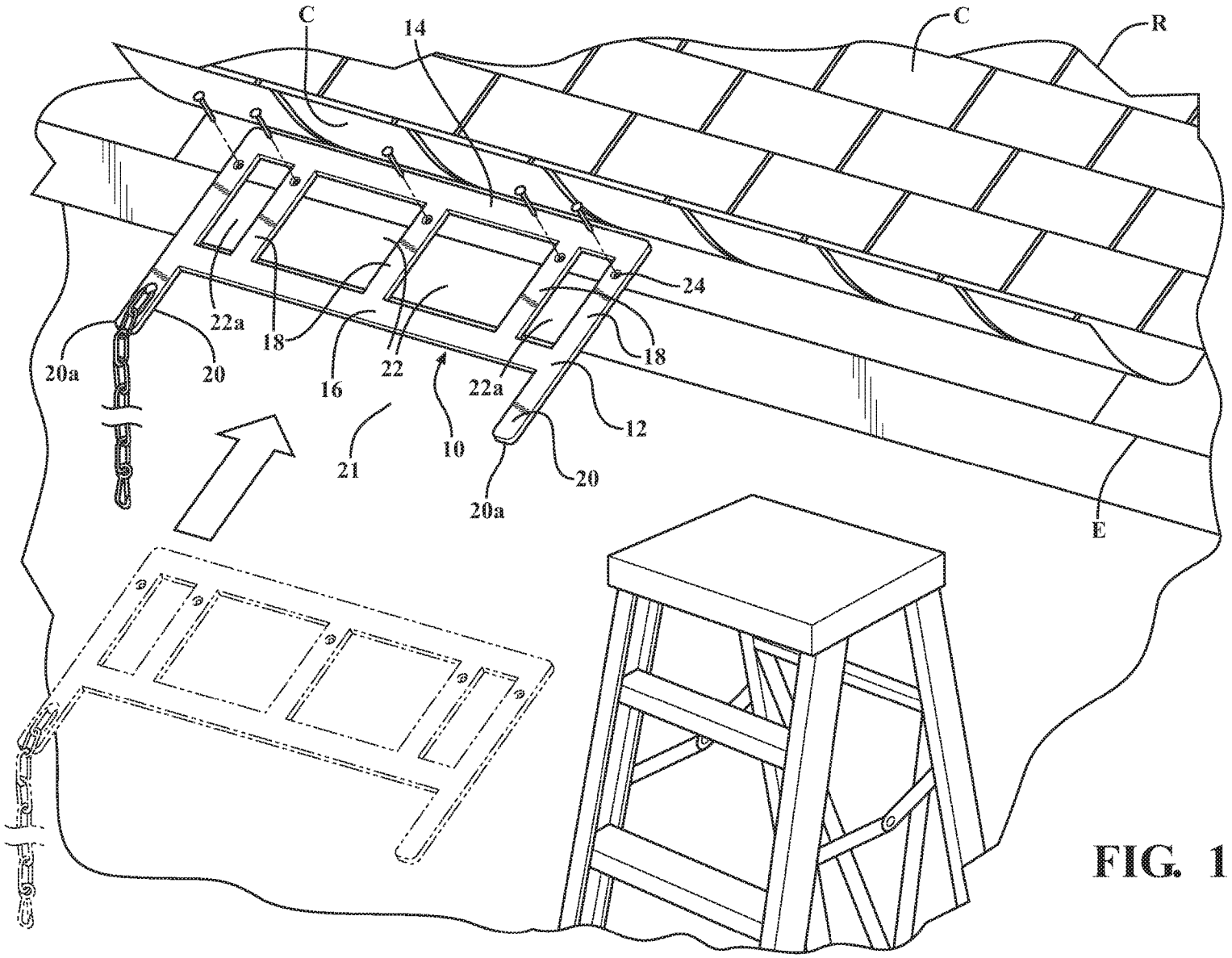
FIG. 1 is a perspective view of an example ladder safety device according to the invention, shown exploded relative to the edge of a roof in solid lines and being installed on the edge of the roof in phantom lines, the roof already being shingled.

Referring first to FIG. 1, a ladder safety device 10 according to the invention is shown in exemplary form in order to teach how to make and use the claimed invention. Ladder safety device 10 comprises a generally flat, planar body 12 made from a rigid, durable material such as steel, aluminum, or high-strength plastic. Body 12 is formed from a plurality of flat, spaced rail members that define a plurality of relatively large hand-grip openings between them.

In the illustrated example, body 12 includes a horizontal inner rail 14, a horizontal outer rail 16 spaced from and generally parallel to inner rail 14, and a plurality of vertical rails 18 generally perpendicular to and joining the horizontal inner and outer rails 14, 16 into a single rigid body. "Horizontal" and "vertical" are used herein as convenient shorthand for the relative alignment of the rails in the plane of body 12, and not as precise designations of orientation relative to the ground, and further can include vertical rails that are not perpendicular to the horizontal rails but extend at an angle between them.

A pair of spaced fingers 20 project outwardly from outer ends of horizontal outer rail 16. Fingers 20 are flat rail members similar to rails 14 and 16, but the fingers terminate in free ends 20*a* to define an opening 21 between them sufficiently wide to receive an extension ladder L. The length of fingers 20 corresponds to the depth of the side rails of the ladder to prevent the ladder from rocking to either side.

Ladder safety device 10 in FIG. 1 is shown installed at the edge E of a roof R, in particular under an existing roof covering C such as a layer of shingles. Ladder safety device 10 is secured to roof R by lifting or loosening the lowermost row of shingles C along the edge of the roof, sliding the inner end defined by inner rail 14 underneath the shingles, and inserting screws through holes 24 formed along inner ends of vertical rails 18 and/or along the inner horizontal rail 14 into the roof. Although the installed safety device 10 is intended to secure an extension or flat ladder, it may be preferred to use a stepladder for the initial installation as shown in FIGS. 1 and 3.

Figure 2:
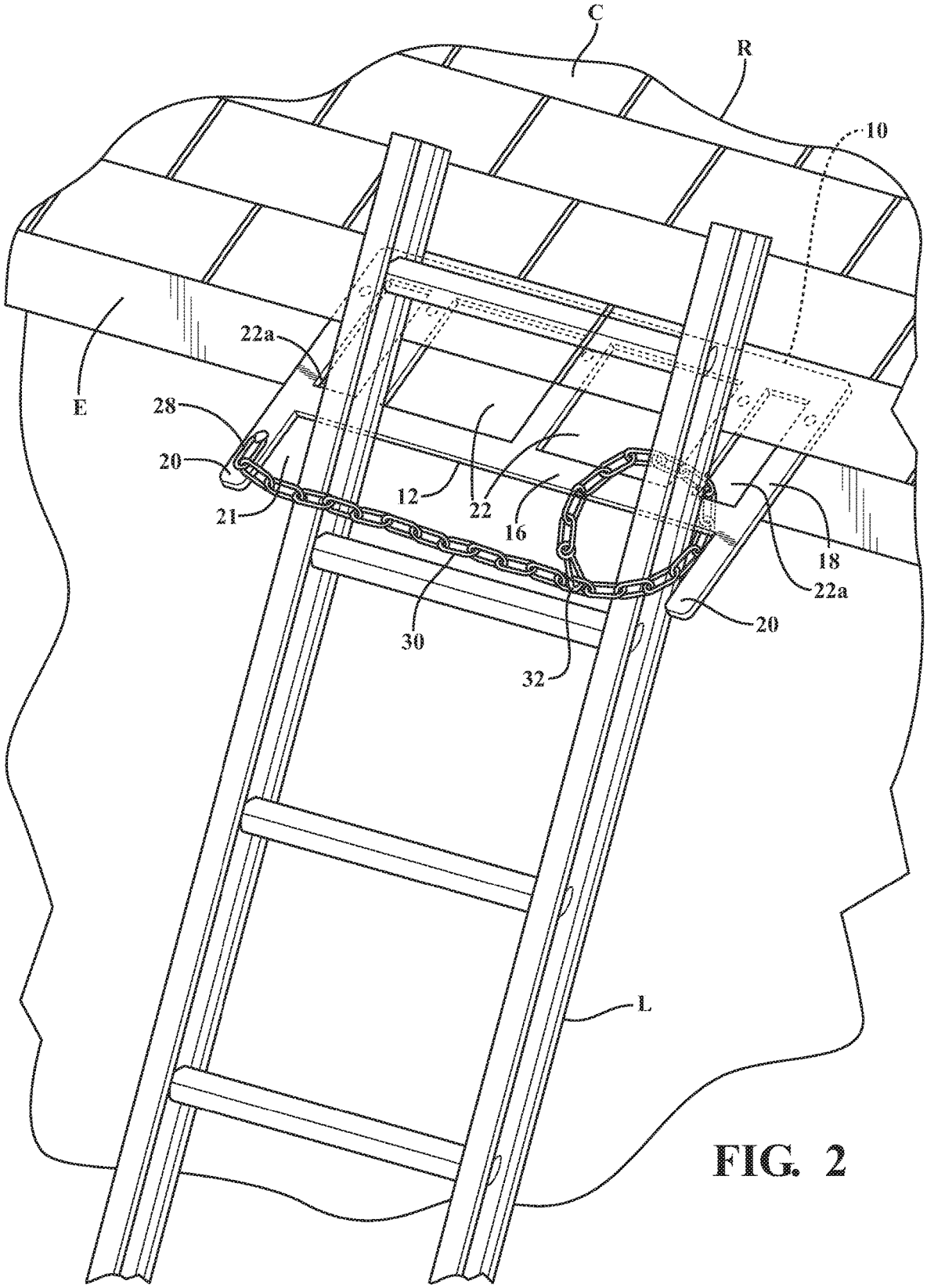
FIG. 2 shows a ladder secured to the ladder safety device of FIG. 1.

FIG. 2 shows a ladder L mounted against ladder safety device 10, with the ladder placed in recess 21 between fingers 20 and further secured with a cable, chain, rope, strap, or similar device 30 (hereafter "chain"). Chain 30 is attached at both ends to ladder safety device 10, in the illustrated example at one end to a clip or hook 28 on one of fingers 20, and at the other end by being looped around the junction of an outer rail 16 and a side vertical rail 18 through an opening 22*a* in body 12 that extends partially beyond the edge E of the roof due to the outer rail 16 being spaced from roof edge E. The chain 30 is clipped to itself with a snap hook or carabiner-type fastener 32 at the end of the chain.

Still referring to FIG. 2, the projection of horizontal outer rail 16 beyond the edge E of roof R (including any edge features such as drip edge or gutters) also prevents ladder L from pressing against and damaging such edge features.

Figure 3:
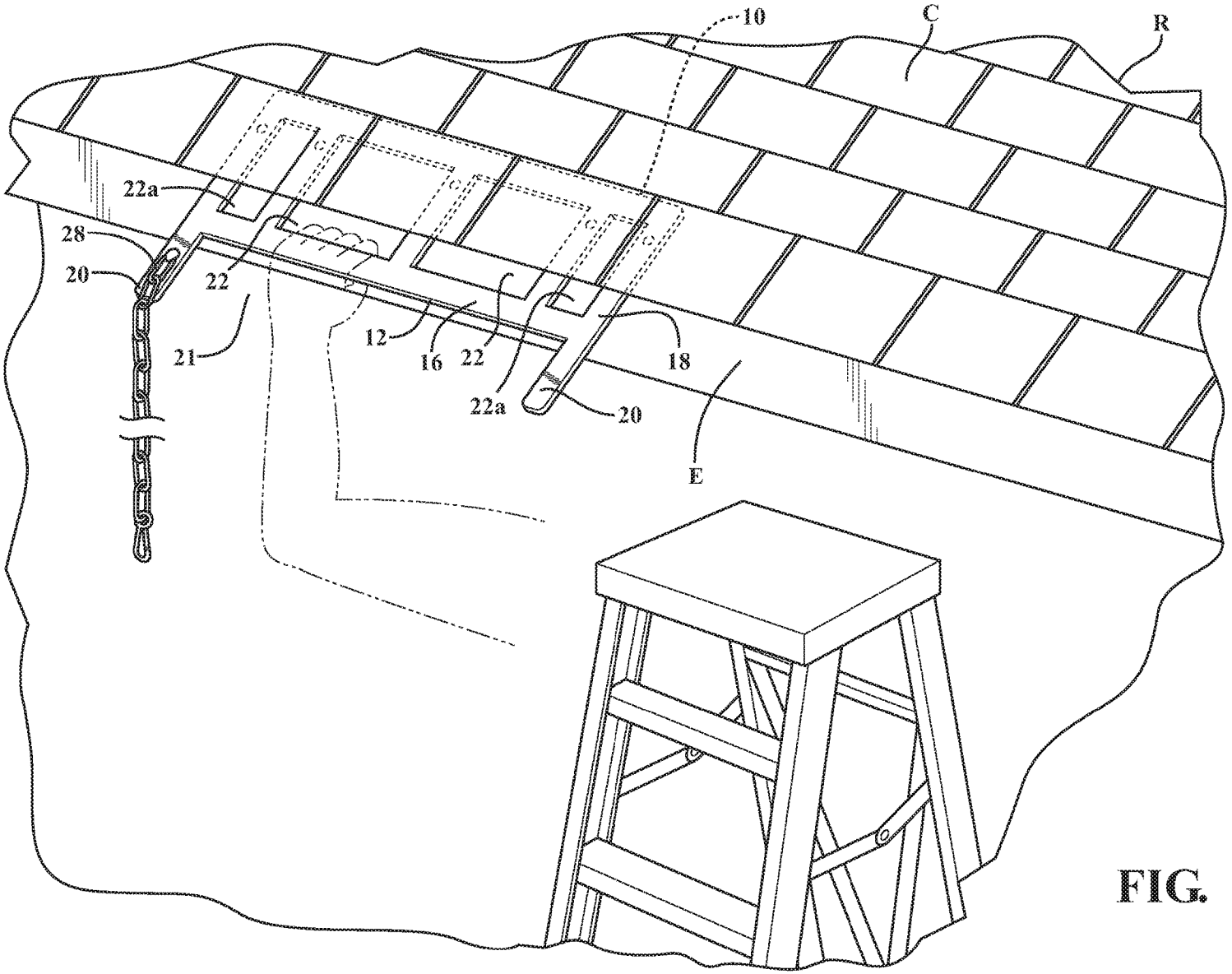
FIG. 3 shows the ladder safety device of FIG. 1 installed next to an unsecured ladder to provide a handhold at the edge of the roof.

FIG. 3 shows ladder safety device 10 being installed on the roof edge by a person standing on an unsecured ladder L (preferably a step-ladder as illustrated) placed adjacent or against the roof edge to one side of the installation location. Ladder safety device 10 is configured with spaced rails 14, 16, and 18 so that large openings 22 are formed in the body between the rails to provide room for a hand to reach through and wrap around and grip an associated rail bordering the opening. In the illustrated example, two outermost vertical rails 18 form the sides of rectangular body 12, while three interior vertical rails 18 interconnect horizontal rails 14, 16 between the sides. The vertical rails in the illustrated example define narrower outer openings 22*a* and wider inner openings 22 in body 12, the openings extending fully between the horizontal inner and outer rails 14, 16. This configuration allows a user to put a hand through the openings at different angles to grasp any of the horizontal or vertical rails and to use them as handles for carrying the ladder safety device 10 up a ladder, and for maneuvering the ladder safety device 10 underneath the shingles and to hold it securely in place with one hand while fastening it to the roof.

The large rectangular opening configuration of body 12 also allows the user to visually align the straight inner edge 16*a* of horizontal outer rail 16 generally parallel to roof edge E, helping to insure a square installation.

Still referring to FIG. 3, ladder safety device 10 is installed with horizontal outer rail 16 spaced from roof edge E, so that portions of the openings 22 between the vertical rails 18 remain open beyond the roof edge, for example on the order of 1-2" (inches) of each opening 22 remaining exposed beyond the roof edge. This installation spacing allows horizontal outer rail 16 to remain viable as a grip during installation to help maneuver and position the ladder safety device; as a wraparound handhold after the ladder safety device 10 has been fastened to the roof.

Figure 4:
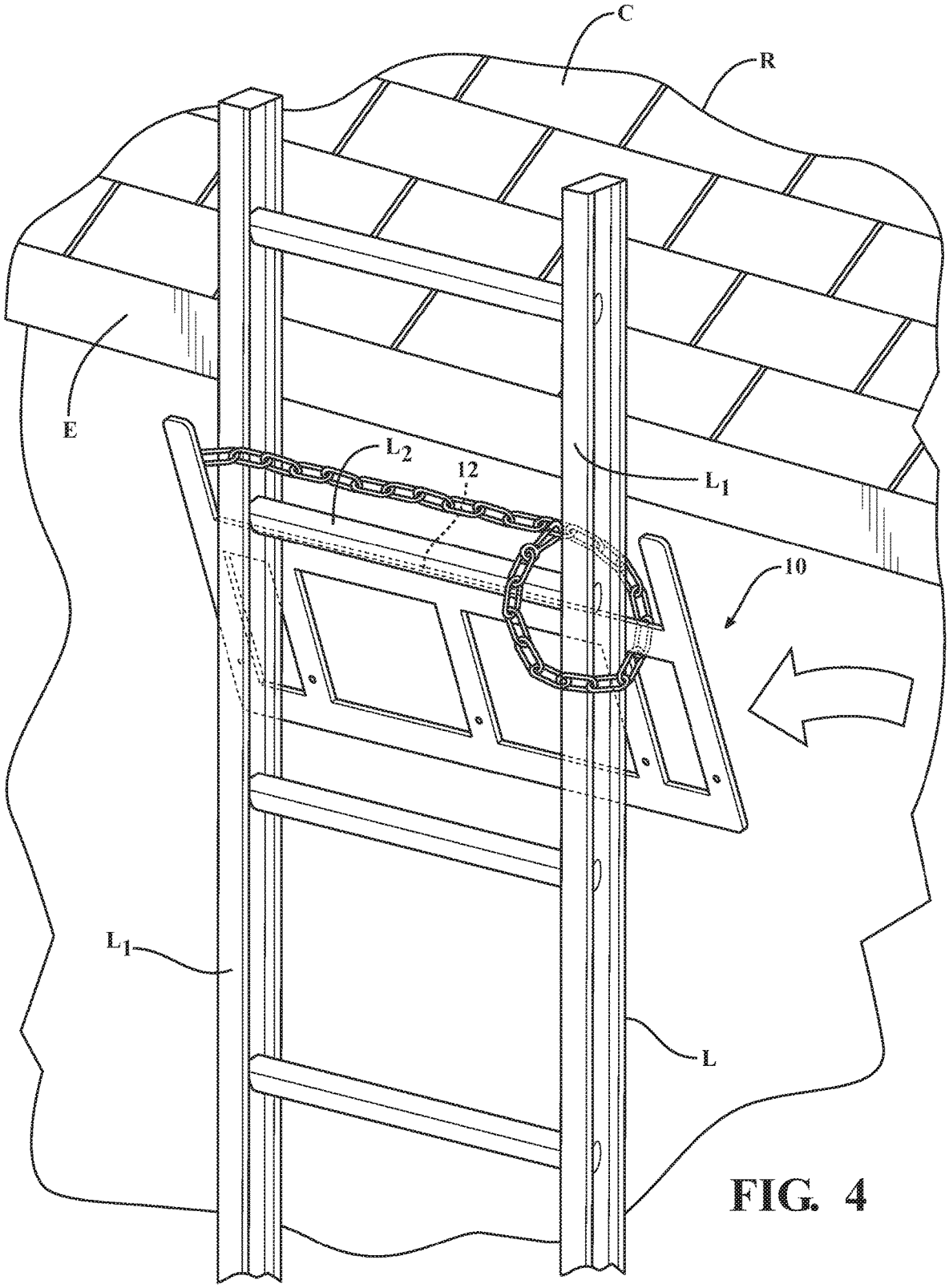
FIG. 4 shows the ladder safety device of FIG. 1 being removed from the roof while attached to the ladder.

Referring to FIG. 4, ladder safety device 10 can be removed from the roof along with ladder L, once the roof fasteners F such as screws have been removed from the inner edge of the ladder safety device. This is accomplished by looping the free end of chain 30 over one of the rungs L2 between the ladder side rails L1, so that when ladder L is pulled away from the roof, ladder safety device 10 hangs from the chain-looped rung and the planar body 12 lies flat against the house-facing side of the ladder.

Figure 5:
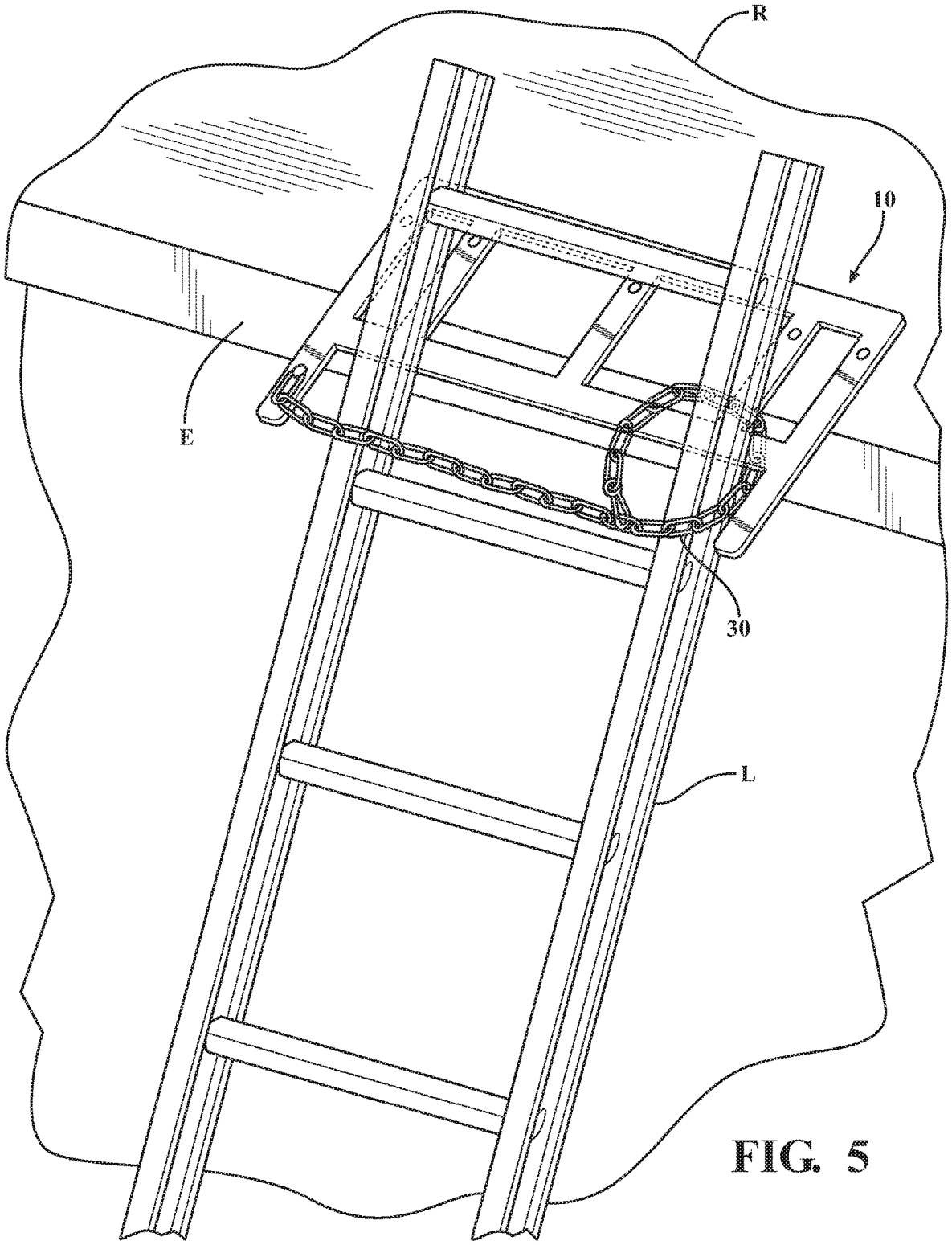
FIG. 5 is similar to FIG. 1, but shows the ladder safety device installed on the edge of a new roof that has not been shingled yet.

FIG. 5 shows ladder safety device 10 installed on a roof R without a pre-existing layer of shingles or other roof covering, for example during new construction. In this case, the ladder safety device may be shingled over up to the roof edge, and later removed when the roof is finished. In this situation, the ladder safety device 10 may be installed over the ice shield material S typically found at the edge of a roof.

Figure 6:
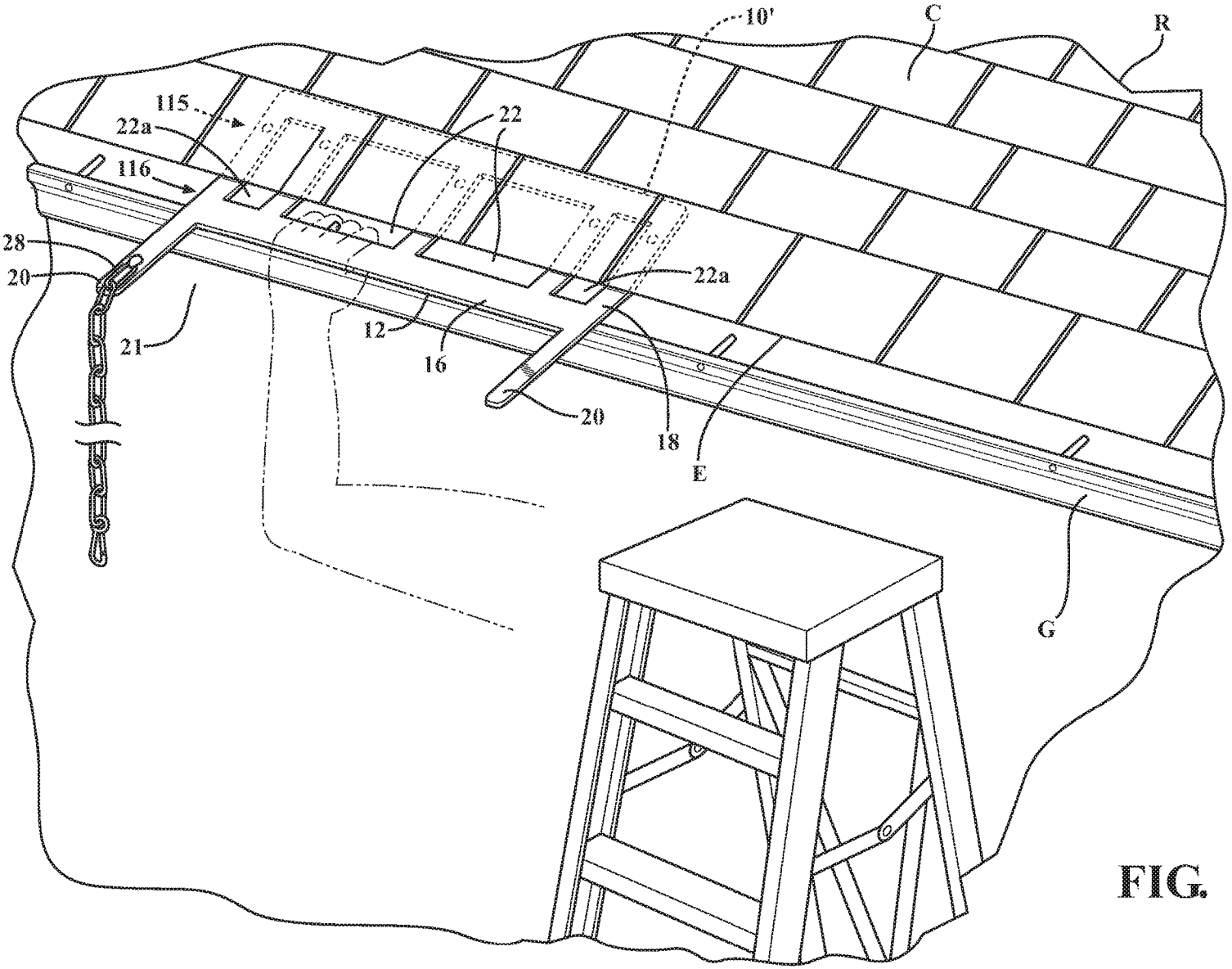
FIG. 6 is similar to FIG. 3, but shows a modified form of the ladder safety device in which an outer body portion is angled to project out over a gutter.
Figure 7:
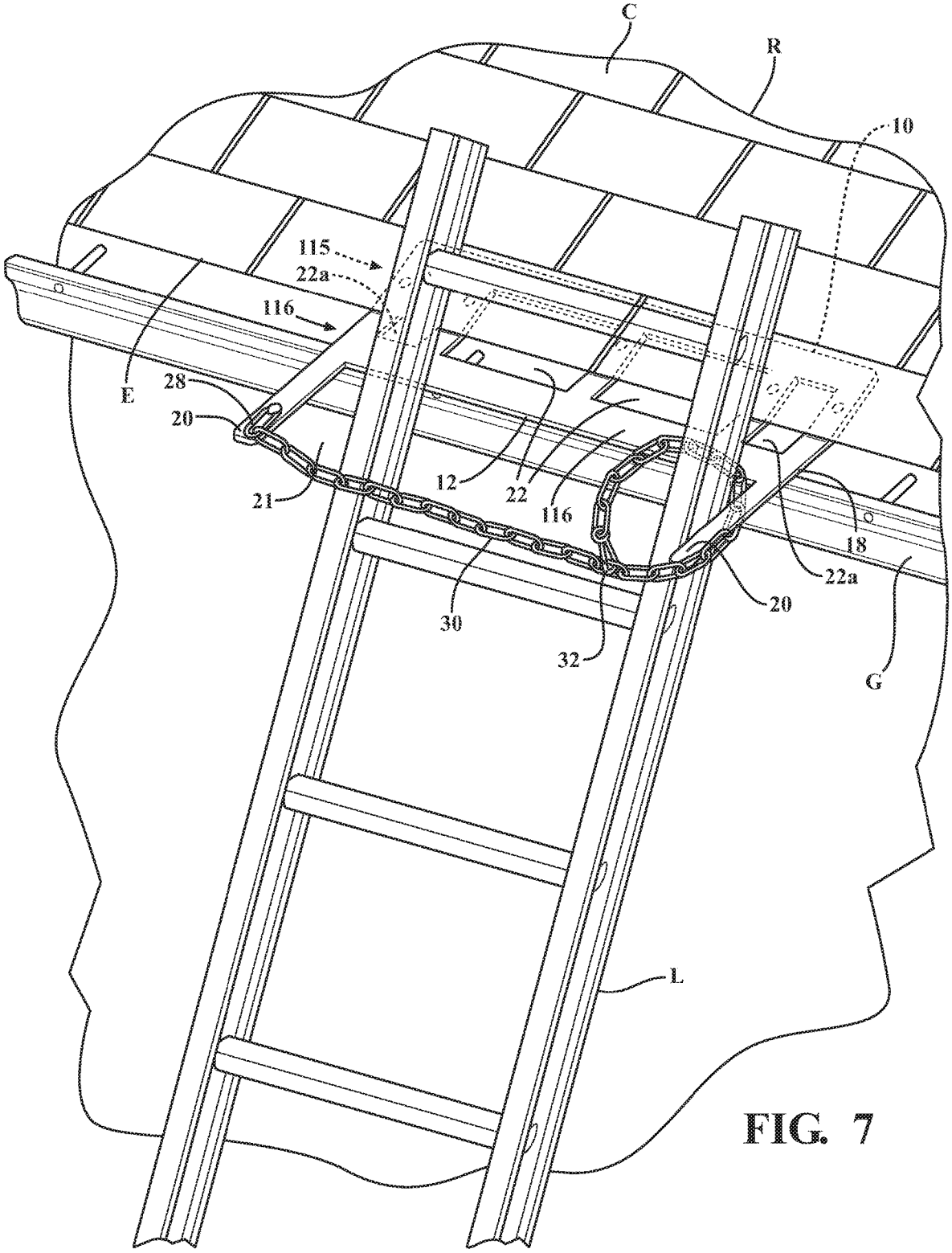
FIG. 7 is similar to FIG. 2, but shows the modified form of the ladder safety device of FIG. 6.

FIGS. 6 and 7 show a modified form 10' of the ladder safety device, in which the lower or outer part of the device comprising outer horizontal rail 16, the outer ends of vertical rails 18, ladder-securing fingers 20, and the outer ends of openings 22 and 22*a* form an angled outer body portion 116 bent or angled upwardly relative to the remainder or inner portion 115 of the device. Angled outer body portion 116 is set at an angle relative to the "inner" body portion 115 (inner horizontal rail 14 and the inner ends of vertical rails 18 and openings 22) such that when the inner body portion 115 is flat against roof R, the outer body portion 116 is extends substantially level above and parallel to the upper plane of a gutter G extending along eave E. Modified ladder safety device 10' accordingly is preferred where the roof eave has gutters. The manner of installation and use of modified ladder safety device 10' is essentially the same as that for device 10 in FIGS. 1-5 above, except that after installation the ladder-securing outer body portion 116 is positioned at a gutter-clearing angle. The angle of outer body portion 116 relative to the remainder or inner portion 115 of the modified ladder safety device 10' may vary to accommodate different roof pitches; for example, a selection of differently-angled devices 10' can be made available to a contractor, corresponding to common roof pitch angles.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. In combination with a roof having a roof edge, a ladder safety device temporarily secured to the roof and comprising:

a substantially flat planar inner body portion comprising flat inner portions of a plurality of horizontally spaced vertical rails, and a flat first horizontal rail interconnecting the inner portions of the vertical rails;

an outer body portion comprising outer portions of the vertical rails and a second horizontal rail spaced vertically from the first horizontal rail and interconnecting the outer portions of the vertical rails;

the vertical rails defining a plurality of hand grip openings horizontally spaced and separated by the vertical rails, the hand grip openings extending fully and continuously in uninterrupted fashion in a vertical direction between the first and second horizontal rails from the outer body portion to the inner body portion, and extending continuously in a horizontal direction between the vertical rails, and the outer body portion including outer portions of the hand grip openings defined by the outer portions of the vertical rails adjacent the second horizontal rail;

a pair of ladder-securing fingers projecting vertically and outwardly from the second horizontal rail to define an open-fronted ladder-receiving recess having a depth sufficient to prevent a ladder positioned between the ladder-securing fingers from sliding sideways off the second horizontal rail; wherein, the outer body portion is substantially planar, the outer body portion being set at a fixed angle with respect to the inner body portion such that the inner and outer body portions form a rigid body, and further wherein the inner body portion is secured to the roof such that the outer body portion including the second horizontal rail, the outer portions of the vertical rails, the outer portions of the hand grip openings, the ladder-securing fingers and the ladder-receiving recess extend beyond the roof edge and such that the first horizontal rail, the inner portions of the vertical rails, and inner portions of the hand grip openings are located inwardly from the roof edge, such that the hand grip openings extend fully and continuously in uninterrupted fashion in the vertical direction across the roof edge.

2. The ladder safety device of claim 1, wherein the first and second horizontal rails are in a parallel spaced relationship and are longer than the vertical rails; and wherein a plurality of fastener holes are formed adjacent the inner ends of the vertical rails adjacent or on the first horizontal rail.

3. The ladder safety device of claim 2, wherein the horizontal rails and the vertical rails are joined at right angles to one another to define the plurality of horizontally spaced hand grip openings as a plurality of large rectangular hand grip openings between them.

4. The ladder safety device of claim 1, wherein the inner and outer body portions are substantially flat and coplanar.

5. The ladder safety device of claim 4, wherein the second horizontal rail and the outer portions of the vertical rails are substantially flat.

6. The ladder safety device of claim 1, wherein the outer body portion is angled upwardly relative to the inner body portion and forms a rigid upwardly-angled extension thereof at the fixed angle such that when the inner body portion is secured to the roof at a roof angle the outer body portion is positioned in a substantially horizontal fixed position.

7. The ladder safety device of claim 6, wherein the outer body portion is a substantially flat planar body portion.

8. A method of installing a ladder safety device on a roof edge, comprising:

providing a ladder safety device comprising a substantially flat planar inner body portion comprising flat inner portions of a plurality of horizontally spaced vertical rails, and a flat first horizontal rail interconnecting the inner portions of the vertical rails, and further comprising an outer body portion comprising outer portions of the vertical rails and a second horizontal rail spaced vertically from the first horizontal rail and interconnecting the outer portions of the vertical rails, the inner body portion and the outer body portion each comprising a substantially planar portion set at a fixed angle with respect to one another to form a rigid unitary whole;

the vertical rails defining a plurality of hand grip openings horizontally spaced and separated by the vertical rails, the hand grip openings extending fully and continuously in uninterrupted fashion in a vertical direction between the first and second horizontal rails and extending continuously in a horizontal direction between the vertical rails, and the outer body portion including outer portions of the hand grip openings defined by the outer portions of the vertical rails adjacent the second horizontal rail; and, a pair of ladder-securing fingers projecting vertically and outwardly from the second horizontal rail to define an open-fronted ladder-receiving recess having a depth sufficient to prevent a ladder positioned between the ladder-securing fingers from sliding sideways off the second horizontal rail; and, securing the inner body portion to the roof through holes formed in the inner body portion such that the outer body portion including the second horizontal rail, the outer portions of the vertical rails, the outer portions of the hand-grip openings, the ladder-securing fingers and the ladder-receiving recess are spaced outwardly from the roof edge and such that the first horizontal rail, the inner portions of the vertical rails, and inner portions of the hand grip openings are located inwardly from the roof edge, such that the hand grip openings extend fully and continuously in uninterrupted fashion in the vertical direction across the roof edge.

* * * * *